US005085065A

United States Patent [19]

Onderka et al.

[11] Patent Number: 5,085,065

[45] Date of Patent: Feb. 4, 1992

[54] UNIVERSAL ROLL STAND AND METHOD OF OPERATING SAME

[75] Inventors: Bernd Onderka, Korschenbroich; Georg Engel, Kaarst; Paul Mauk, Düsseldorf; Hugo Feldmann, Alsdorf-Warden, all of Fed. Rep. of Germany

[73] Assignee: SMS Schloemann-Siemay Aktiengesellschaft, Dusseldorf, Fed. Rep. of Germany

[21] Appl. No.: 532,258

[22] Filed: Jun. 1, 1990

Related U.S. Application Data

[63] Continuation-in-part of Ser. No. 373,877, Jun. 29, 1989, abandoned.

[30] Foreign Application Priority Data

Jun. 30, 1988 [DE] Fed. Rep. of Germany ..... 3821990

[51] Int. Cl.[5] ..... B21B 37/00

[52] U.S. Cl. ..... 72/8; 72/225; 72/234; 364/472

[58] Field of Search ..... 72/8, 17, 225, 234; 364/472

[56] References Cited

U.S. PATENT DOCUMENTS

| | | | |
|---|---|---|---|
| 4,030,326 | 6/1977 | Morooka et al. | 72/8 |
| 4,236,216 | 11/1980 | Anbe | 72/8 |
| 4,248,072 | 2/1981 | Hasegawa et al. | 72/8 |
| 4,617,814 | 10/1986 | Kotera | 72/8 |
| 4,625,536 | 12/1986 | Morooka | 72/17 |
| 4,705,969 | 11/1987 | Gross | 324/166 |
| 4,706,479 | 11/1987 | Tominaga | 72/8 |
| 4,864,838 | 9/1989 | Engel et al. | 72/225 |

FOREIGN PATENT DOCUMENTS

| | | | |
|---|---|---|---|
| 55-94704 | 7/1980 | Japan | 72/225 |
| 55-126311 | 9/1980 | Japan | 72/225 |
| 1006234 | 9/1965 | United Kingdom | 72/225 |
| 1031037 | 5/1966 | United Kingdom | 72/17 |

*Primary Examiner*—Robert L. Spruill
*Assistant Examiner*—Thomas C. Schoeffler
*Attorney, Agent, or Firm*—Herbert Dubno; Andrew Wilford

[57] ABSTRACT

A workpiece is advanced through a succession of universal roll stands each having a pair of rotatably positively driven horizontal rolls engaging horizontal surfaces of the workpiece and a pair of idling vertical rolls engaging vertical surfaces of the workpiece and normally only rotationally entrained by engagement with the advancing workpiece. The roll stand is controlled by detecting the peripheral speeds of the vertical rolls and generating outputs corresponding thereto and then comparing the outputs to set points and generating error signals corresponding to the difference. The peripheral speed and position of the horizontal rolls are detected to establish same as operating characteristics. Finally the peripheral speeds of the vertical rolls are varied in accordance with the respective differences by varying at least one of the operating characteristics. Such variation is done by changing the crosswise position and/or the peripheral speed of the horizontal rolls, as the vertical/horizontal speed ratio is affected both by amount of vertical compression and amount of tension in the workpiece.

6 Claims, 2 Drawing Sheets

UNIVERSAL ROLL STAND AND METHOD OF OPERATING SAME

CROSS REFERENCE TO RELATED APPLICATION

This application is a continuation-in-part of my copending patent application 07/373,877 filed 29 June 1989 (now abandoned).

FIELD OF THE INVENTION

The present invention relates to a system for rolling steel profiles. More particularly this invention concerns a universal roll stand and a method of operating same.

BACKGROUND OF THE INVENTION

It is standard to roll steel profiles—I-beams, H-beams, and the like—in a rolling string comprised of a succession of universal roll stands each having a pair of horizontal working rolls that engage the top and bottom surfaces of th profile and a pair of vertical working rolls that engage its sides. Each time the workpiece passes through such a universal stand at least one of its vertical or horizontal dimensions is reduced and the workpiece mass distribution is changed, typically its length is augmented.

In fact as the rolling operation progresses the relative amounts of vertical and horizontal compression and, hence, of elongation change, thereby also changing the ratio between the peripheral speeds of the vertical and horizontal rolls. As a result in the same universal roll stand the workpiece can be subjected to uncontrollable changes in cross section resulting in substantial internal stresses caused by lateral shifts of material as the workpiece is being rolled. Such lateral material flow is not desired; instead the flow is supposed to be longitudinal for the desired longitudinal grain orientation that imparts the desired strength to the workpiece.

As a rule the horizontal rolls are positively driven, but the vertical rolls have no drives and in fact ar rotated by engagement with the workpiece so that in effect they idle. It is normally considered impossible to provide drives for the vertical rolls due to space limitations. Even when the peripheral speeds of the vertical rolls are generally stable at a predetermined level relative to the peripheral speeds of the horizontal rolls of the same stand, substantial problems in the overall movement of the workpiece through the succession of roll stands result in a changing peripheral-speed ratio as rolling progresses. Even changes in the tension exerted in the strand from one roll stand to the next are reflected in the peripheral speeds and also in the material flow. Also such peripheral-speed ratio changes result in accelerations of the horizontal rolls and the material of the workpiece can affect the ratio of the peripheral speeds of the horizontal and vertical rolls.

Such material-flow changes caused by the change in the speed ratios are not wanted. Since the workpiece volume does not change it is necessary for the material to flow transversely when it cannot elongate. The result can therefore be a workpiece that varies in cross-sectional measurements, a clearly unacceptable product as it is impossible to control whether this transverse material flow is taking place in the desired locations or not. In addition the prior-art systems can lead to the production, from blanks of the same volume, of workpieces of different lengths and workpieces having, for instance, one flange that is wider than the other when the workpiece is supposed to be symmetrical.

OBJECTS OF THE INVENTION

It is therefore an object of the present invention to provide an improved rolling system and method.

Another object is the provision of such an improved rolling system and method which overcomes the above-given disadvantages, that is which produces a perfectly uniform product.

SUMMARY OF THE INVENTION

The instant invention relates to a rolling method wherein a workpiece is advanced through a succession of universal roll stands each having a pair of rotatably positively driven horizontal rolls engaging horizontal surfaces of the workpiece and a pair of idling vertical rolls engaging vertical surfaces of the workpiece and normally only rotationally entrained by engagement with the advancing workpiece, According to this invention the roll stand is controlled by detecting the peripheral speed of the vertical rolls and generating outputs corresponding thereto and then comparing the outputs to set points and generating error signals corresponding to the difference. The peripheral speed and position of the horizontal rolls are detected to establish same as operating characteristics. Finally according to the invention the peripheral speeds of the vertical rolls are varied in accordance with the respective differences by varying at least one of the operating characteristics. Such variation is done by changing the crosswise position and/or the peripheral speed of the horizontal rolls, as the vertical/horizontal speed ratio is affected both by amount o-f vertical compression and amount of tension in the workpiece.

Thus with the system of this invention the system is adjusted such that peripheral speeds of the horizontal and of the vertical rolls can be set to a predetermined level relative to each other, normally identical, and maintained constant at this level by adjusting roll position or horizontal-roll speed. As a result of eliminating peripheral-speed variations between the horizontal and vertical rolls workpiece irregularities resulting therefrom are eliminated.

According to this invention the speed of the one pair of vertical rolls is varied as the workpiece is passing through the plurality of stands. The speed of not only the horizontal rolls but also of the vertical rolls is set before the workpiece enters the stand. Thus according to a feature of this invention small drives are provided to get the vertical rolls up to the desired speed even before they engage the workpiece, thereby eliminating the normally unusable leading-end portion of the workpiece that is caused by the workpiece engaging stationary vertical rolls.

The speeds of the vertical rolls of the one pair are varied with respect to each other, that is one vertical roll of a given stand can be slightly different from the other roll of the stand when that is called for according to the invention. This makes it possible to take into account the workpiece thickness, its flange width and to us the position of the vertical rolls and/or the rotation thereof to ensure that, even with an asymmetrical workpiece, this workpiece passes straight through the stand. It can also produce a particular curve in the workpiece when same is desired, for instance for prestressing purposes.

According to another feature of this invention the speed of the horizontal rolls of the one pair is varied relative to the speed of the vertical rolls of the one pair to obtain a predetermined ideal no-slip point. When the various outputs, or difference signals derived from them, are multiplied by a preprogrammed factor it is possible to obtain extremely uniform workpieces.

It is also within the scope of this invention to vary the speeds of all of the vertical rolls with respect to one another in accordance with a predetermined desired amount of tension in the workpiece. This is best done by applying the control techniques of this invention to most of the stands in the system, so as to control the no-slip point and transverse material flow optimally. One of the stands is normally made to operate without control so that the other stands upstream and/or downstream of it are regulated according to this invention for perfect tension control. The last and/or the first stand is ideally the stand whose speed is not regulated according to this invention.

The apparatus of this invention therefore has sensors for detecting the actual peripheral speeds of the vertical rolls and generating outputs corresponding thereto and a controller for connected to the positioners and/or drives for the horizontal rolls for varying the peripheral speed of at least on of the pairs of vertical rolls relative to the other vertical rolls in accordance with the outputs of the other rolls. In addition positioners and/or rotary drives are provided for the vertical rolls and the controller is connected to thereto to operate same in accordance with the outputs. The sensor means include tachometers connected to the respective vertical rolls and the controller includes means for comparing the outputs with set points. Another sensor is provided for detecting the peripheral speeds of the horizontal rolls and producing outputs corresponding thereto and the controller also processes these horizontal-roll outputs.

DESCRIPTION OF THE DRAWING

The above and other objects, features, and advantages will become more readily apparent from the following, reference being made to the accompanying drawing in which.

SPECIFIC DESCRIPTION

Figure 1:
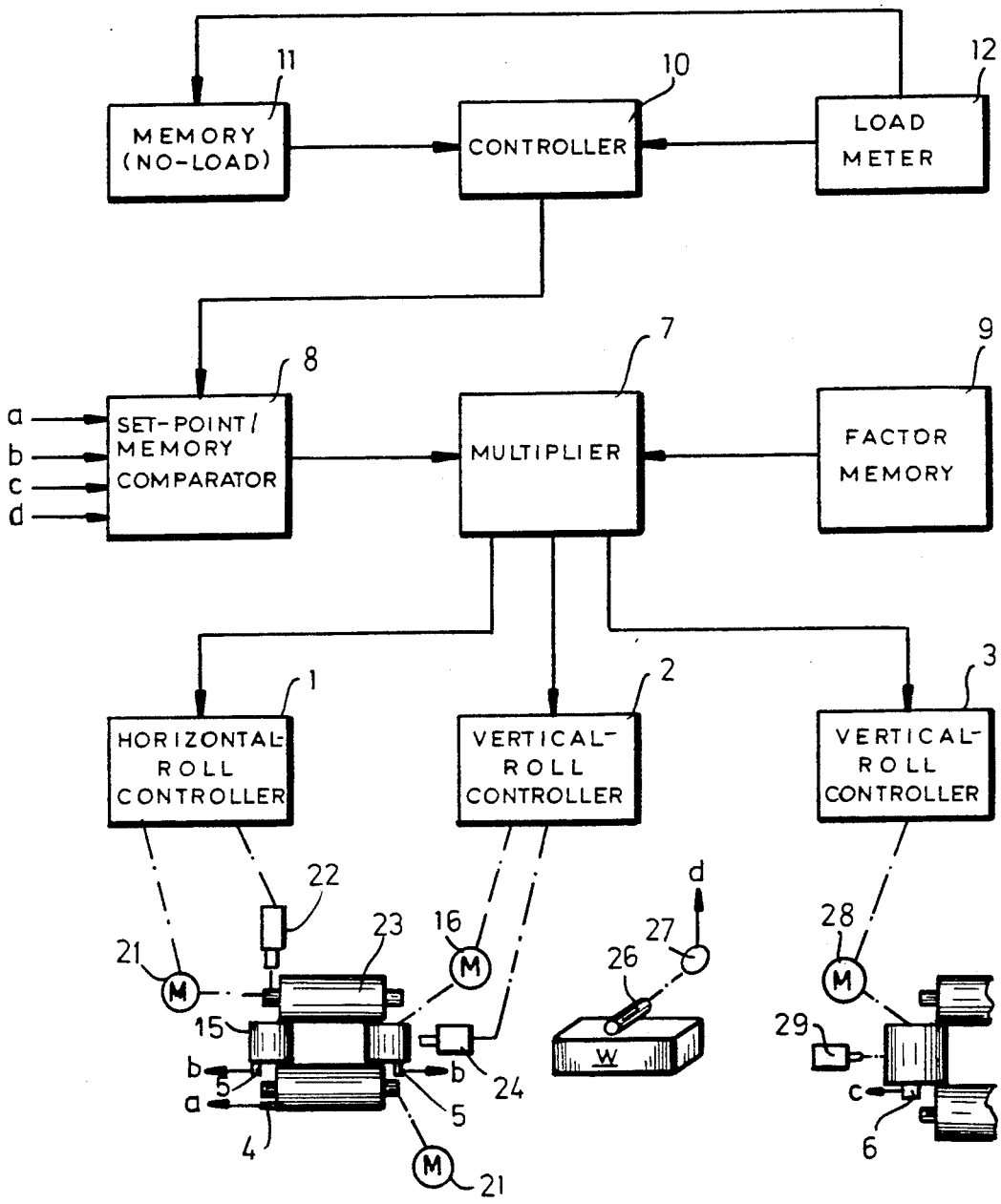
FIG. 1 is a mainly diagrammatic block diagram illustrating the method of this invention.

FIG. 1 shows a control circuit 1 for the motors 21 and positioners 22 of the horizontal rolls 23 of a universal rolling stand, a control circuit 2 for the motor 16 and positioner 24 of one of the vertical rolls 15 of the stand, and a controller 3 for the motor 28 and positioner 29 of the vertical roll 15 of the next downstream stand. The peripheral speed of the horizontal rolls 23 of the first stand is monitored by sensors 4 generating outputs a corresponding thereto and the peripheral speeds of the vertical rolls 15 are represented by outputs b and c. The travel speed of the workpiece w which moves upstream to downstream (left to right in FIG. 1) is monitored by a roller 26 and sensor 27 that generates an output d. These elements are duplicated further down the rolling string for subsequent stands.

These outputs a, b, c, and d are all fed to a device 8 that compares them to respective set points and feeds the resultant difference signal to a multiplier 7 that multiplies them b a factor derived from a memory 9, equalizing the factors of all the controllers 1, 2, and 3. As a rule at least the factors for the horizontal-roll controller 1 and for the two vertical-roll controllers 2 and 3 are different, although this in no way excludes the fact that the factors for the two vertical-roll controllers 2 and 3 can be different from each other.

In accordance with the instant invention the comparator 8 and multiplier 7 divide the signal corresponding to the periperhal speeds of the horizontal rolls 23 by the signal corresponding to the peripheral speed of the vertical rolls 15. The resultant quotient is compared to a set point, for instance 1.0, and the horizonal position of the vertical rolls is adjusted by the actuator to eliminate the difference between the quotient and the setpoint, that is between the two speeds. The result is rolling with no cross-flow of material which is evidenced by a difference between the two peripheral speeds.

Another controller 10, which can supply the set points to the unit 8, compares the power consumption of each stand as determined by a meter 12 with the power it consumes when not loaded, as stored in a memory 11, and triggers the other elements of this device to ensure that they are responding to real operating circumstances, that is it triggers speed corrections only when it determines that a given roll stand is actually engaging the workpiece w. Once the workpiece w gets to the next stand the actual value from the meter 12 is fed to the controller 10 so same can set the system at a power level which corresponds to that of a single stand. Thus minimal tension is created between the roll stands. This prevents the workpiece w from being under excessive tension between adjacent strands and also prevents it from being under so little tension that it can loop or hang, as is possible for instance with thin sheet stock. The elements lo, 11, and 12 which are connected to the elements 1 through 8 serve thus to ensure this minimal-tension control while the elements 1 through 9 serve for a single roll stand and, as mentioned above, are duplicated for each of the controlled roll stands.

Figure 2:
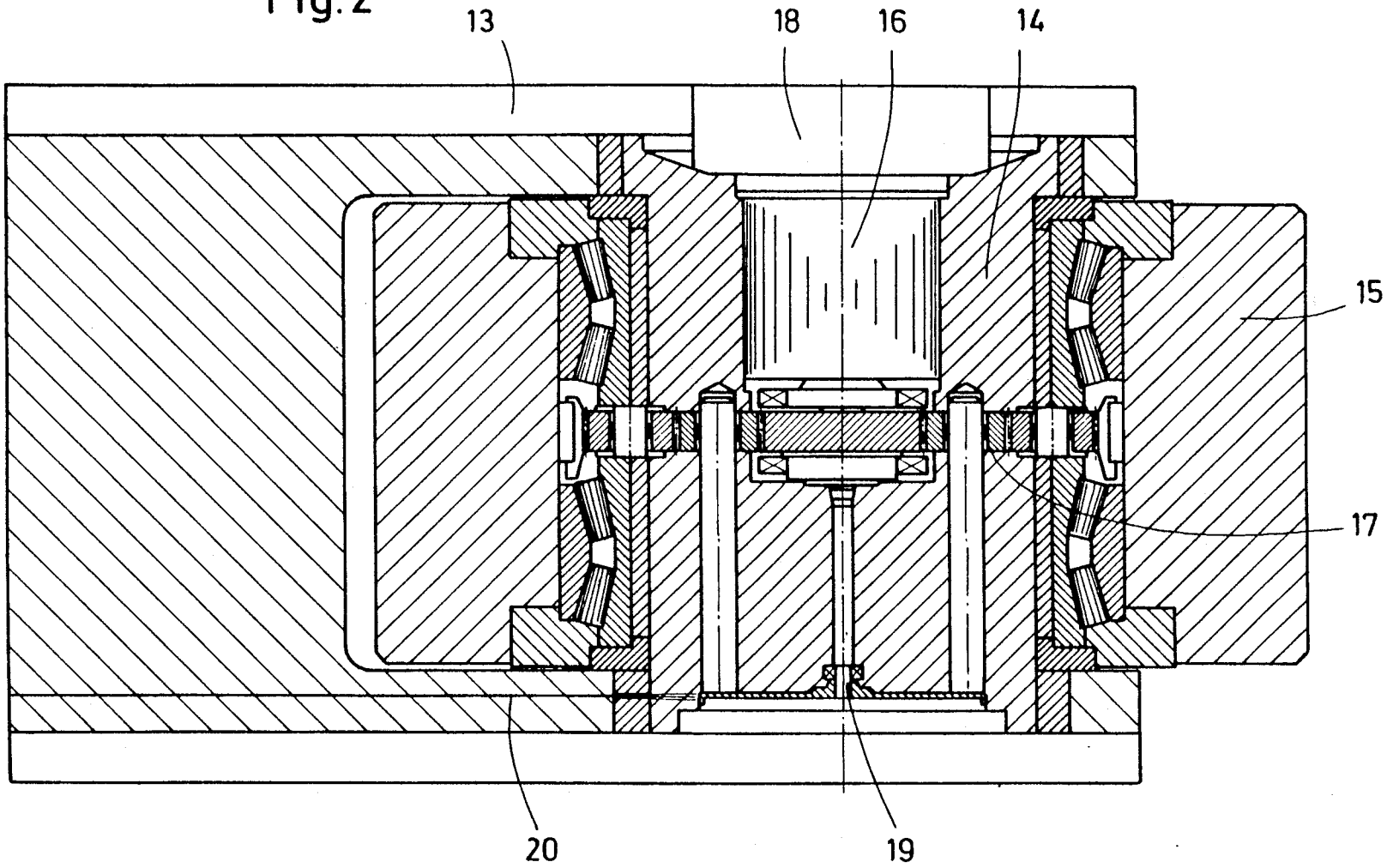
FIG. 2 is a vertical section through a vertical roll of a universal stand according to this invention.

FIG. 2 shows a support 13 for an axle 14 of the vertical rolls 15. This axle 14 contains the hydraulic motor 16 for the roll 15, the output shaft of this motor 16 being connected to the sun gear of a planetary transmission 17 whose planet gears cannot orbit and whose ring gear is fixed on the roll 15. The motor 16 is a small-capacity device only serving to get the respective roll 15 up to speed before the workpiece w engages the roll 15 but thereafter is ineffective as the roll 15 idles. The motor 16 also directly drives a cup-shaped disk !9 whose periphery has a multiplicity of reflective spots and/or holes so that its rotation can be sensed by a fiber-optical cable 20 forming part of the speed sensor 5 or 6.

We claim:

1. In a rolling method wherein a workpiece is advanced through a succession of universal roll stands each having a pair of rotatably positively driven horizontal rolls engaging horizontal surfaces of the workpiece and a pair of idling vertical rolls engaging vertical surfaces of the workpiece and normally only rotationally entrained by engagement with the advancing workpiece, a control method comprising the steps of:

detecting the peripheral speed of the vertical rolls and generating an output corresponding thereto;

detecting the peripheral speed of the horizontal rolls and generating an output corresponding thereto;

dividing one of the roller outputs by the other roll output and generating a quotient corresponding thereto;

comparing the quotient to a set point and generating an error signal corresponding to the difference; and varying the horizontal positions of the vertical rolls in accordance with the difference and so as to minimize the error signal.

2. The rolling method defined in claim 1 wherein the peripheral speeds of the individual vertical rolls are detected and are varied with respect to each other even within the same pair of vertical rolls.

3. The rolling method defined in claim 1 wherein one pair of vertical rolls is driven by a motor of limited power at a predetermined speed before the workpiece enters the plurality of stands but thereafter idles and is driven only by contact with the workpiece.

4. The rolling method defined in claim 1 wherein the operating characteristic that is varied is the speed of the horizontal rolls of each stand relative to the speed of the vertical rolls of the respective stand, the horizontal-roll speed being varied to obtain a predetermined ideal no-slip point.

5. The rolling method defined in claim 1 wherein the speeds of all of the vertical rolls are varied with respect to one another in accordance with a predetermined desired amount of tension in the workpiece.

6. The rolling method defined in claim 1 wherein the speeds of the vertical rolls of generally all of the universal stands are varied.

* * * * *